US008196542B2

(12) United States Patent
Oswell et al.

(10) Patent No.: US 8,196,542 B2
(45) Date of Patent: Jun. 12, 2012

(54) WATER SPORTS FOLDABLE TOWING APPARATUS AND METHOD

(75) Inventors: Robert Oswell, Acheson (CA); Richard Behnke, Acheson (CA); George Cant, Sydney (AU)

(73) Assignee: Roswell Wake-Air, Acheson, AB (CA)

( * ) Notice: Subject to any disclaimer, the term of this patent is extended or adjusted under 35 U.S.C. 154(b) by 32 days.

(21) Appl. No.: 12/763,024

(22) Filed: Apr. 19, 2010

(65) Prior Publication Data

US 2010/0319603 A1 Dec. 23, 2010

Related U.S. Application Data

(60) Provisional application No. 61/170,732, filed on Apr. 20, 2009.

(51) Int. Cl.
*B63B 17/00* (2006.01)

(52) U.S. Cl. ..... 114/364; 114/343

(58) Field of Classification Search ..... 114/253, 114/343, 361, 364, 378; 180/89.14, 89.15, 180/89.18

See application file for complete search history.

(56) References Cited

U.S. PATENT DOCUMENTS

| | | | | |
|---|---|---|---|---|
| 4,114,718 | A * | 9/1978 | Lipshield | 180/89.14 |
| 5,934,217 | A | 8/1999 | Allsop | |
| 5,979,350 | A | 11/1999 | Larson et al. | |
| 6,044,788 | A | 4/2000 | Larson et al. | |
| 6,192,819 | B1 | 2/2001 | Larson et al. | |
| 6,374,762 | B1 | 4/2002 | Larson et al. | |
| RE37,823 | E | 9/2002 | Larson et al. | |
| 6,666,159 | B2 | 12/2003 | Larson et al. | |
| 6,711,783 | B2 | 3/2004 | LeMole | |
| 6,792,888 | B1 | 9/2004 | Metcalf | |
| 6,854,413 | B2 | 2/2005 | Jackson et al. | |
| 6,925,957 | B2 | 8/2005 | Schultz | |
| 6,986,321 | B2 | 1/2006 | Metcalf | |
| 6,997,131 | B2 | 2/2006 | Jackson et al. | |
| 7,017,509 | B2 | 3/2006 | Schultz | |
| 7,216,604 | B2 | 5/2007 | Finney et al. | |
| 7,219,617 | B2 | 5/2007 | Metcalf | |
| 7,234,408 | B1 | 6/2007 | Clemmons et al. | |
| 7,299,761 | B2 | 11/2007 | Larson et al. | |
| 7,392,758 | B2 | 7/2008 | Metcalf | |
| 7,418,918 | B2 | 9/2008 | Bierbower et al. | |
| 7,497,184 | B1 | 3/2009 | Chaffin et al. | |
| 7,536,971 | B1 | 5/2009 | Fry | |
| 2008/0156250 | A1 | 7/2008 | Clemmons et al. | |
| 2008/0264325 | A1 | 10/2008 | Tevlin | |
| 2009/0178604 | A1 | 7/2009 | McKeand | |
| 2009/0320738 | A1 | 12/2009 | Blumberg | |

* cited by examiner

*Primary Examiner* — Lars A Olson

(74) *Attorney, Agent, or Firm* — Holland & Knight LLP; Brian J. Colandreo, Esq.; Jeffrey T. Placker, Esq.

(57) ABSTRACT

A towing apparatus comprises a structural assembly extending between opposing first and second bases for pivoting between operating and stored positions. A locking assembly includes a pin in each base and a hook carried at opposing ends of the structural assembly. A cam is pivotally connected to the hook for movement between locked and released positions. In the locked position, the hook is secured to the pin for preventing rotation of the structural assembly. In the released position, the hook is spaced from the pin to permit rotation of the structural assembly. The hook is rotatable with the cam from the released position to adjacent the pin by rotation of a shaft and slidable along the pin into the locking position by a continued shaft rotation. A cable is attached between the base and a spring within the structural assembly for biasing the structural assembly toward the operating position.

25 Claims, 8 Drawing Sheets

WATER SPORTS FOLDABLE TOWING APPARATUS AND METHOD

CROSS-REFERENCE TO RELATED APPLICATION

This application claims priority to and incorporates the disclosure by reference of Provisional Patent Application Ser. No. 61/170,732 for WATER SPORTS TOWING TOWER SYSTEM AND ASSOCIATED METHODS, filed Apr. 20, 2009.

FIELD OF THE INVENTION

The present invention generally relates to towing of a performer by a water sporting tow boat, and more particularly to a towing structure providing stability to the vessel during a towing operation and storage of the tower.

BACKGROUND OF THE INVENTION

As is well accepted at this writing, wakeboarding is one of the most popular water sports in the world. As a result, there is an increasing need for a vessel or towboat to create a larger wake to ride and an efficiently controlled towrope. Unlike waterskiing, the performer on a wakeboard is looking for as large a wake as possible. Further, by anchoring the towline at a high elevation above the boat deck, there is a greater ability of the performer to be lifted higher into the air, whether with a ski or wakeboard. As disclosed in U.S. Pat. No. 7,299,761 for a Water Sports Towing Apparatus, the disclosure of which is herein incorporated by reference in its entirety, wakeboarding performance is improved using a vessel which is fitted with a towing structure having spaced supports attached on opposite sides of the vessel while coupling upper extremities of the supports with a bridging portion, to which a towrope attachment point is fitted. There is also a need to improve upon visibility by a pilot of a vessel while providing efficiency in operation and storage of the towing structure. The present invention improves upon known towing structures.

SUMMARY OF THE INVENTION

In view of the foregoing background, the present invention seeks to maintain aerial characteristics of a performance by a performer using a water sport implement, such as a wakeboard or ski, by way of example, the performer being towed by a vessel having efficiency in operation and handling of both the vessel and tower.

The invention may be embodied in an apparatus comprising a first base and a second base positioned in spaced relation to the first base. A structural assembly extends between and is pivotally connected to the first and second bases for movement between an open position and a closed position. A locking assembly is operable with the structural assembly and at least one of the first and second bases. The locking assembly may comprise a pin carried by at least one of the structural assembly and the base, a hook rotatably carried by at least one of the base and the structural assembly, and a cam pivotally connected to the hook for movement of the hook between a locked position and a released position and a locked position. In the locked position, the hook includes a hooking portion secured to the pin for fixing the structural assembly to the base, thus preventing a rotation of the structural assembly with the base. In the released position, the hooking portion is spaced from the pin so as to permit rotation of the structural assembly about the base. In operation, the hook is rotatable with the cam from the released position to adjacent the pin by rotation of the shaft in one direction and the hooking portion slidable along the pin into the locking position by a continued rotation of the shaft in the one direction. A handle may be removably or affixedly attached and operable with the shaft for rotation thereof and manual movement of the hook.

Biasing means may be provided for operation with the structural assembly and at least one of the first and second bases. The biasing means may comprise cable means having one end attached to at least one of the structural assembly and the at least one of the first and second bases, and spring means having one end attached to at least one of the structural assembly and the base, wherein an opposing end of the cable means is attached to an opposing end of the spring means so as to rotatably bias the structural assembly toward the closed position.

The invention may further be embodied in a towing apparatus described as including an upwardly extending first base connected to the one gunwale of the sports boat and an upwardly extending second base connected to an opposing gunwale. An upwardly extending structural assembly may be described as including, but not limited to a first curved side pivotally connected to the first base (respective lower portion) and a second curved side pivotally connected to the second base. Each of the curved sides includes a latch providing locking means for locking each curved side to its respective base. The latch may comprise a cam lock and handle for causing a hook portion of the cam lock to be moved between a locked position and an unlocked position. The cam lock may be pivotally connected within the lower portion and operable with a pin fixed to the upper portion for latching the hook to the pin and thus the upper portion to the lower portion. The latch may be carried within a cavity of the base or side in which the locking means comprises an engaging portion and locking portion extending into the cavity.

Yet further, biasing means may be carried within at least one of the first and second sides and bases for biasing the side toward the base sufficiently to overcome a force of gravity lowering the side when the base is secured to the vessel when the latch is in the unlocked position, while permitting the side to be manually lowered.

The first and second curved sides may be joined at their upper portions or alternatively connected to a top section. The top section may be dimensions to accommodate a width dimension of the vessel such that the bases and sides are appropriate for any width vessel and the top section is modified to permit the upper portions of the sides to be rigidly connected with each base rigidly secured to starboard and port sides of the vessel as desired.

BRIEF DESCRIPTION OF THE DRAWINGS

Embodiments of the invention are described by way of example with reference to the accompanying annotated drawings and photographs in which.

DETAILED DESCRIPTION OF THE PREFERRED EMBODIMENTS

The present invention will now be described more fully hereinafter with reference to the accompanying drawings and photographs, in which embodiments of the invention are illustrated by way of example. This invention may, however, be embodied in many different forms and should not be construed as limited by the embodiments set forth herein. Rather, these embodiments are provided so that this disclosure will be thorough and complete, and will fully convey the scope of the invention to those skilled in the art.

Figure 1:
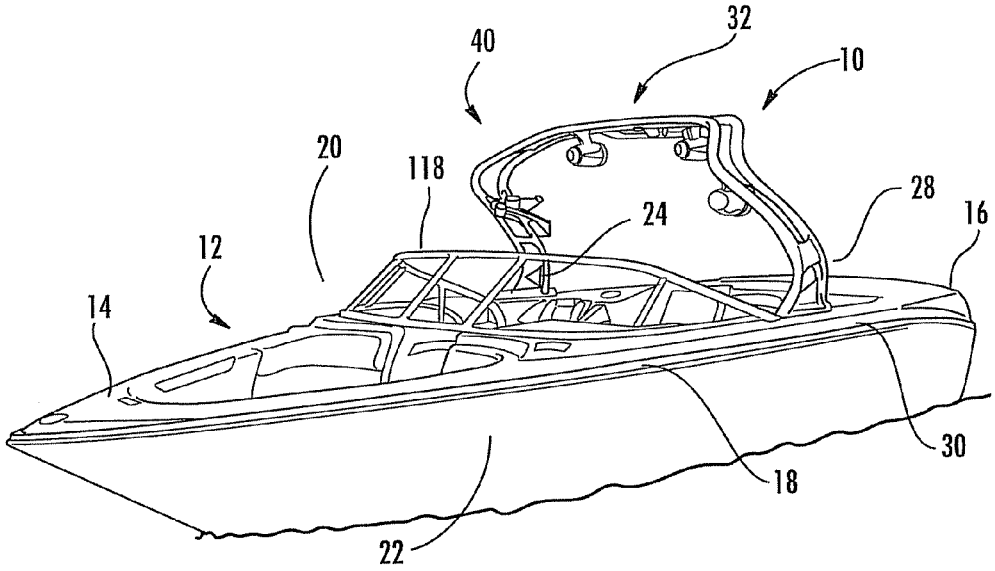
FIG. 1 is a perspective view of a vessel having a towing apparatus according to the teachings of the present invention.
Figure 2:
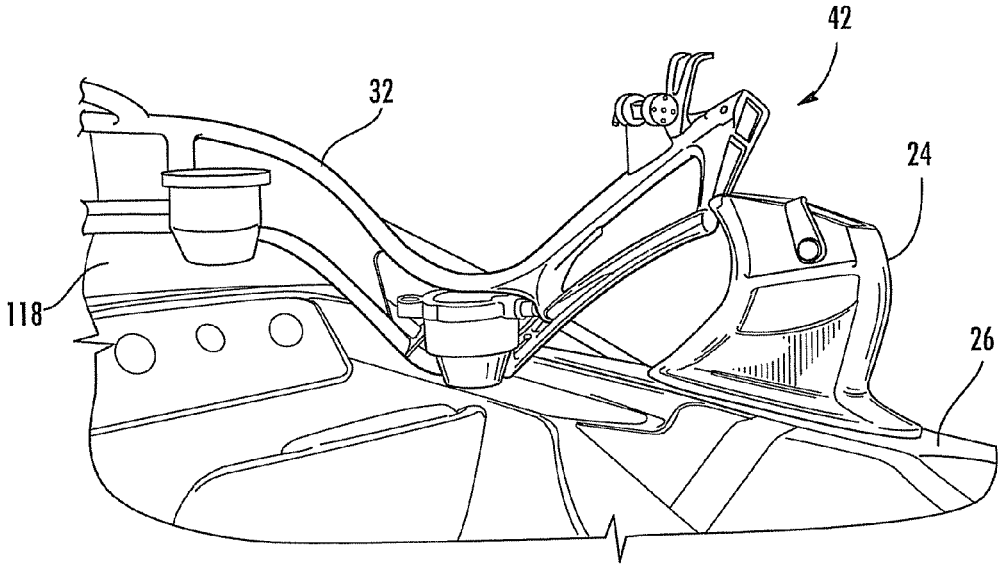
FIG. 2 is a partial perspective view of the towing apparatus illustrated in a stored position within the vessel.

Referring now initially to FIG. 1, one embodiment of the invention includes an apparatus 10 herein referred to as a towing tower, by way of example, for improving aerial characteristics of a performance by a performer using a wakeboard, water ski and the like. The apparatus for the vessel 12, herein described by way of example as a sports boat, is fitted to the vessel behind which the performer is to be towed. As herein presented, the vessel 12 may be described as including a bow 14, a stern 16 and an operator station 18 positioned generally amidships and between a starboard side 20 and a transversely opposing port side 22. As herein described, by way of example, the towing tower 10 may be affixed to the vessel 12 aft of the operator station 18 to allow for improved visibility by a pilot during the towing operation of the vessel.

Figure 6A:
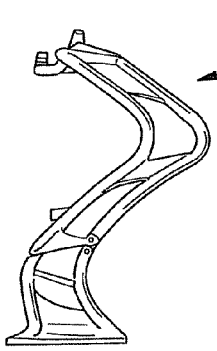
FIGS. 6A, 6B and 6C are side views of the embodiment of FIG. 3 illustrating a range of motion from an operating position to the stored position.
Figure 6B:
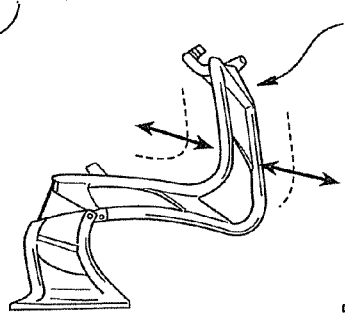
Figure 6C:
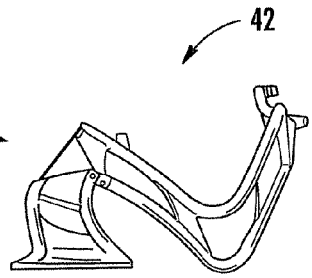

With continued reference to FIG. 1, and to FIGS. 2-5, an upwardly extending first base 24 is fixedly attached to a starboard gunwale 26 and an upwardly extending second base 28 is fixedly attached to the a port gunwale 30. An upwardly extending structural assembly 32 extends between the first and second bases 24, 28. The structural assembly 32 includes a lower first side 34 pivotally connected to the first base 24 and a lower second side 36 pivotally connected to the second base 28 for rotatable movement about pivot points 38 of the structural assembly between a towing position 38 (see FIGS. 1 and 3) to a stored position 40 (see FIGS. 2 and 5). FIGS. 6A, 6B and 6C further illustrated movement from the towing position 40 to the stored position 42 through intermediate positions 44.

Figure 3:
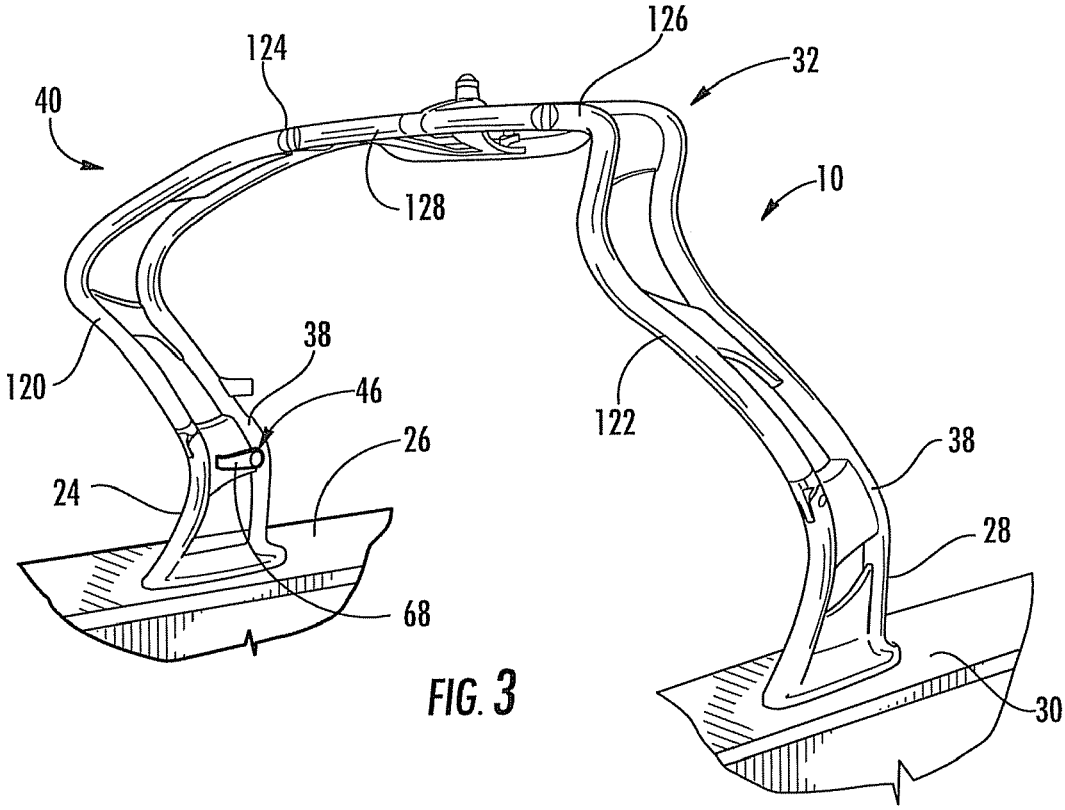
FIGS. 3 and 4 are front and rear perspective views, respectively, illustrating one embodiment of the invention.
Figure 4:
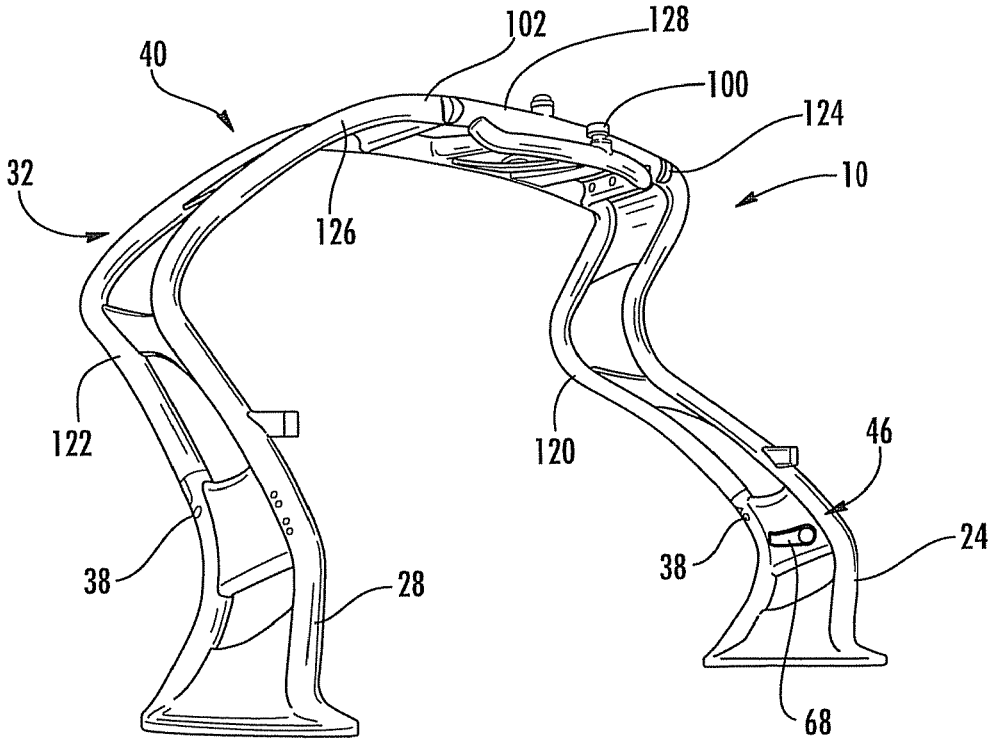
Figure 5:
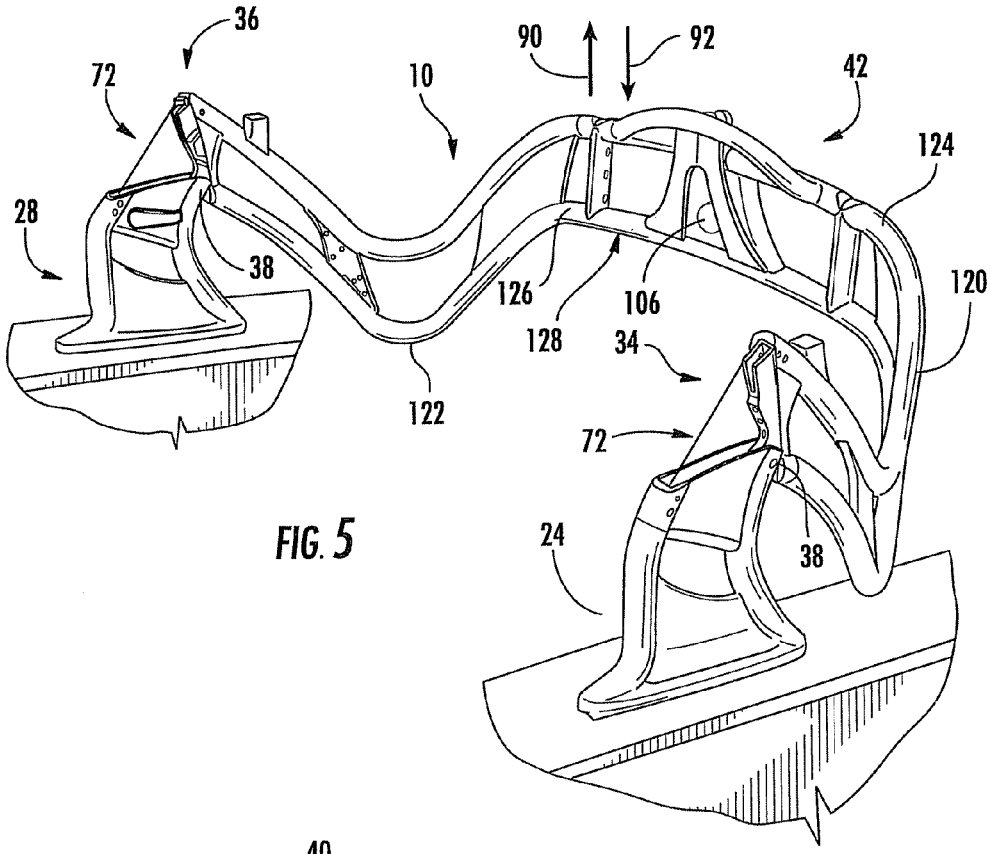
FIG. 5 is a rear perspective view of the embodiment of FIG. 3, illustrating the towing tower in a folded and stored position.
Figure 7:
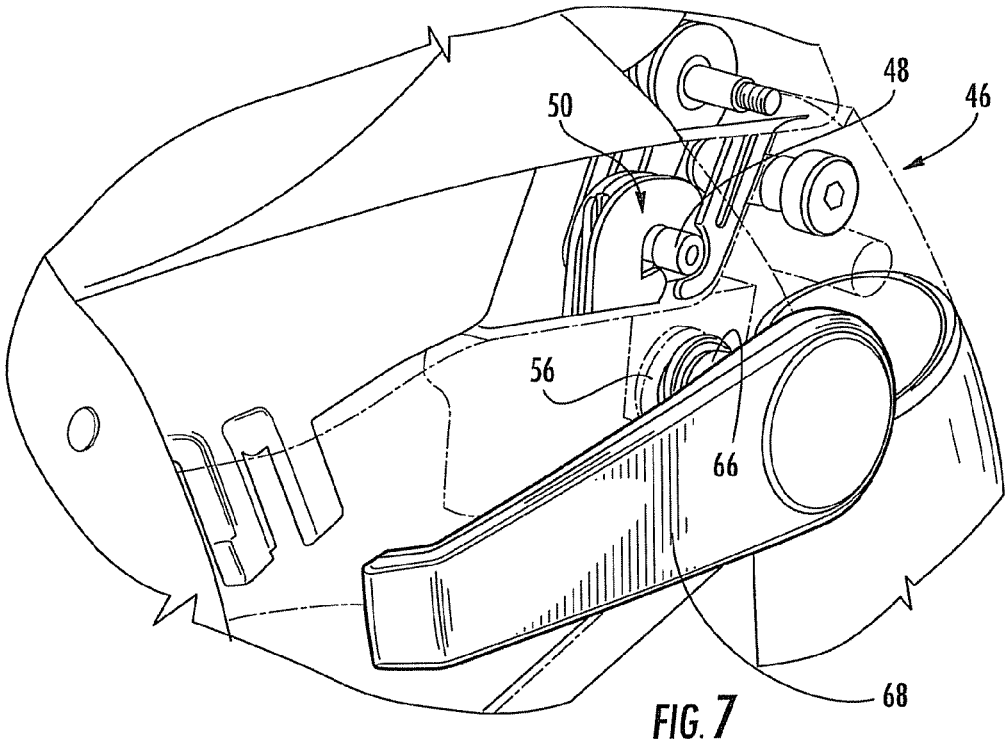
FIGS. 7 and 8 are partial transparent views of a cam-lock mechanism used in the embodiment of FIG. 3 illustrating a hook in a locked positions biased with a pin.
Figure 8:
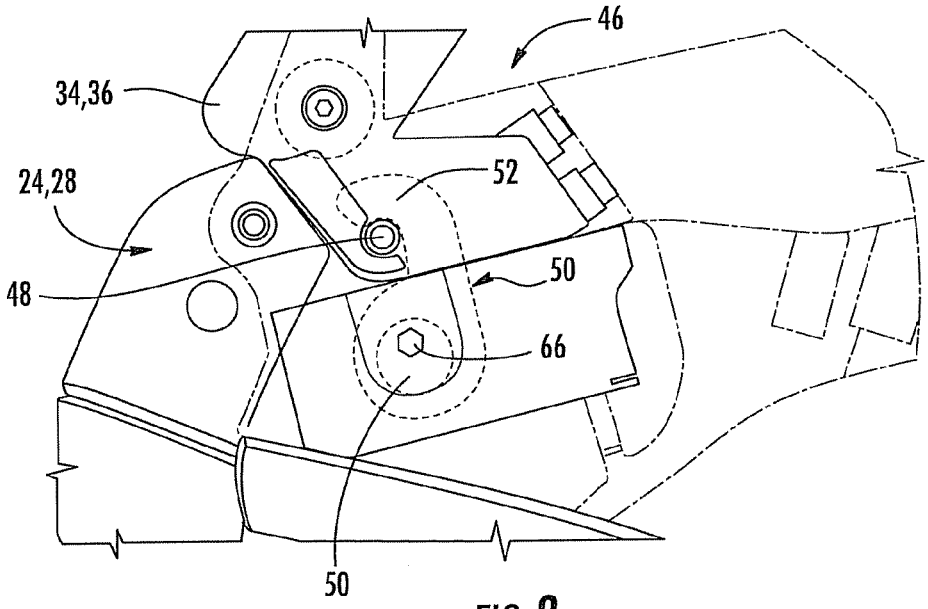
Figure 9A:
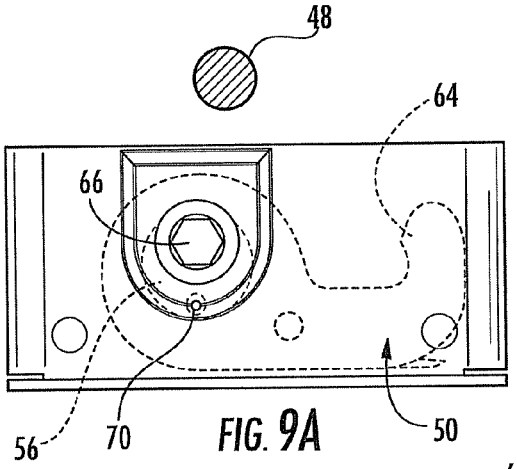
FIGS. 9A, 9B, 9C and 9D are partial side views of a hook and pin illustrating movement from a released or unlocked position to a locked position of the embodiment illustrated in FIG. 3.
Figure 9B:
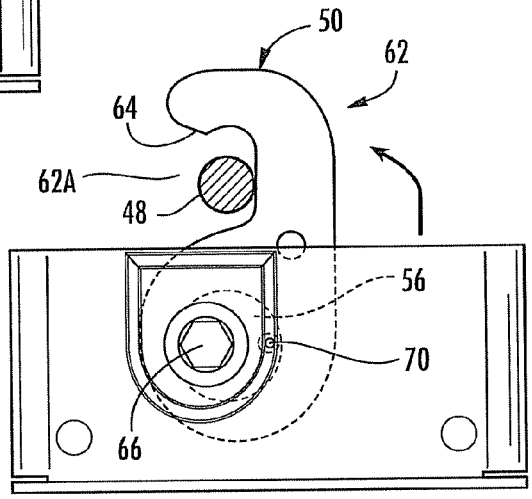
Figure 9C:
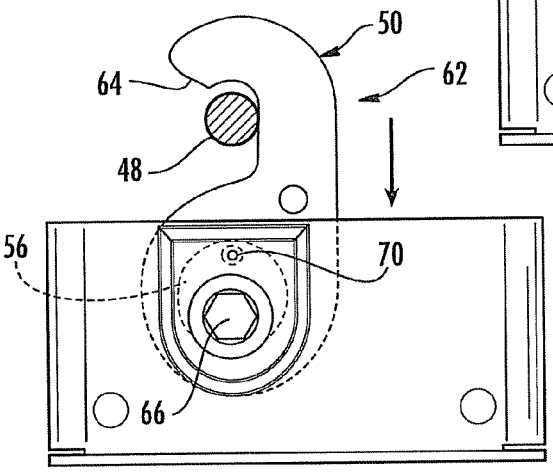
Figure 9D:
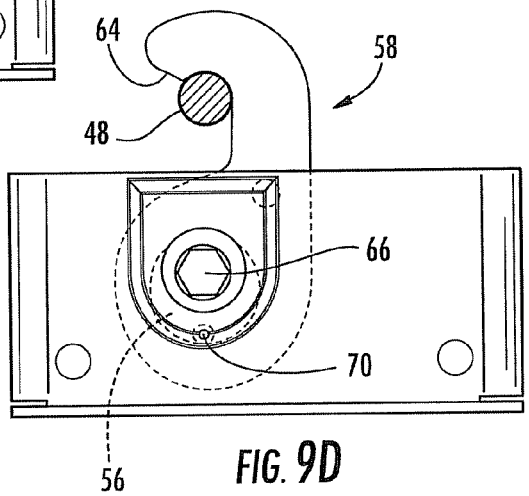

With continued reference to FIGS. 3 and 4, and now to FIGS. 7 and 8, a locking assembly 46 is operable with the structural assembly 32 and at least one of the bases 24, 28. For the embodiment herein described by way of example, there is one locking assembly 32 operable with the structural assembly first side 34 and a similar locking assembly operable with the structural assembly second side 36. Each locking assembly 46 is herein described as comprising a pin 48 carried by at least one of the structural assembly 32 and the base 24, 28 and a hook 50 rotatably carried by at least one of the base 24, 28 and the structural assembly 32. For the embodiment herein described by way of example, the pin 48 is affixed within the structural assemble 32 at each lower side 34, 36 as illustrated with continued reference to FIGS. 7 and 8. For the embodiment herein described, the pin 48 is attached to a tab 52 extending from the structural assembly lower sides 34, 36 and into a cavity of the bases 24, 28, wherein the hook is carried within the cavity. A cam 56 is pivotally connected to the hook 50 for movement of the hook between a locked position 58 and a released position 60 through an intermediate position 62.

With continued reference to FIGS. 7 and 8, and now to FIGS. 9A-9D, in the locked position 58, the hook 50 includes a hooking portion 64 secured to the pin 48 (see FIG. 9D) for fixing the structural assembly 32 to the bases 24, 28, thus preventing a rotation of the structural assembly with the bases. In the released position 60, the hooking portion 64 is spaced from the pin 48 so as to permit rotation of the structural assembly 32 about the bases 24, 28.

With continued reference to FIGS. 9A-9D and as above described, the base comprises the cavity 54, wherein the hook 50 and the cam 56 are carried within the cavity. As illustrated with reference to the sequence of FIGS. 9A-9D, the cam is manually rotated by a shaft 66. Rotation of the shaft is made using a handle 68 illustrated in FIGS. 3 and 7. By way of example, a rotation of the shaft 68 from the released position (see FIG. 9A) to a first intermediate position 62A (see FIG. 9B) results in a rotation of the hook 50 upwards against the pin 48, wherein the hooking portion 64 is spaced from the pin 48. Continued rotation of the shaft 66 results in a rotation of the cam 56 so as to cause the hooking portion 64 to be drawn toward the pin 48 (see FIG. 9C). Completion of the handle 68 and thus shaft 66 rotation manually brings the hooking portion 64 in a locking engagement with the pin 48 (see FIG. 9D). Such movement of the hook 50 is a result of the offset pivotal connection 70 of the hook with the cam 56. In other words, the hook 50 is rotatable with the cam 56 from the released position 60 (FIG. 9A) to adjacent the pin 48 (FIG. 9B) by rotation of the shaft 66 and thus cam 56 in one direction (counter clockwise as herein illustrated by way of example) and the hooking portion 64 is then slidable along the pin 48 (FIG. 9C) until the hook 50 is placed into the locked position 58 by a continued rotation of the shaft in the one direction.

Figures 10, 11, 12:
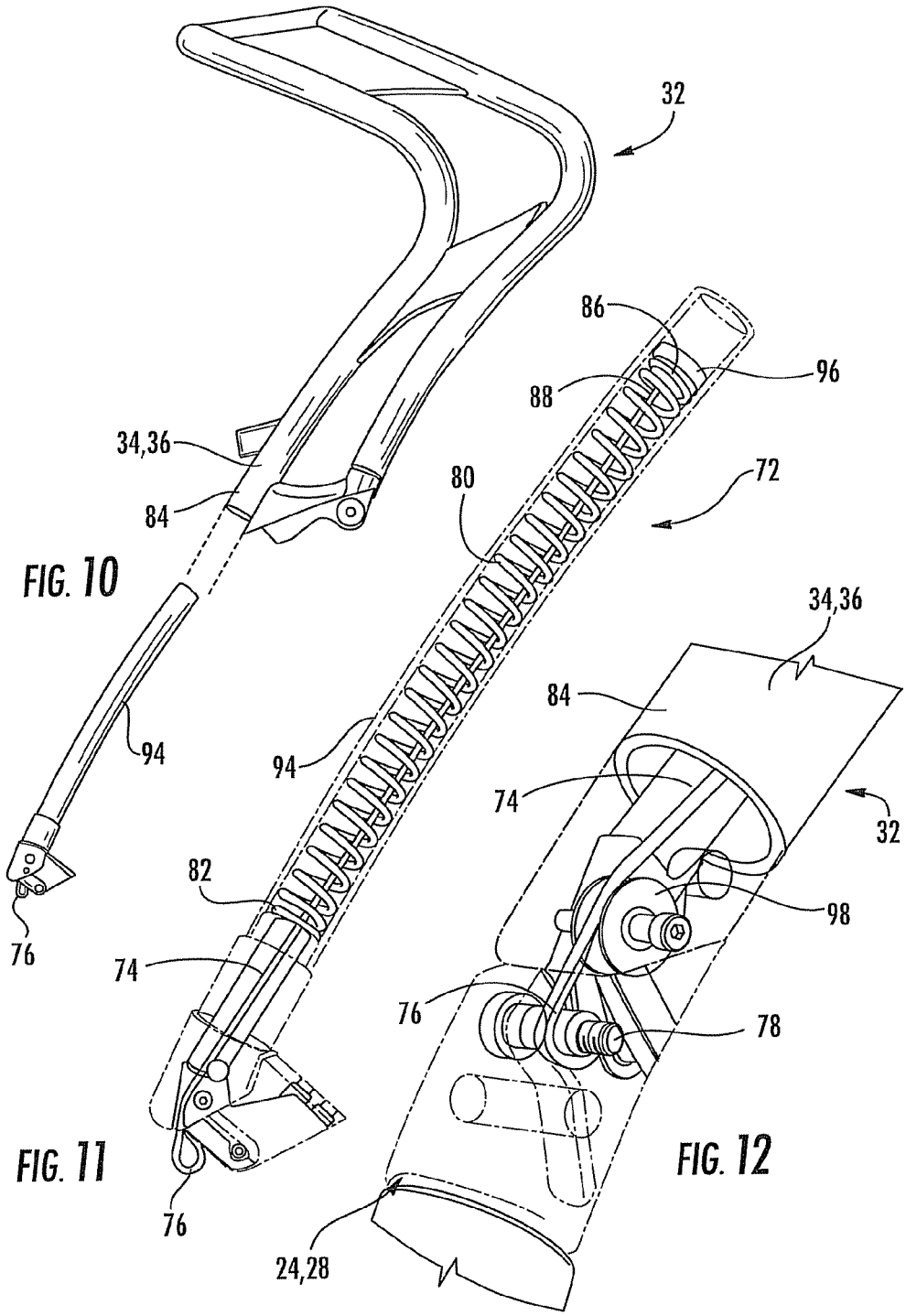
FIG. 10 is a partial perspective and exploded view of a biasing means operable with a structural assembly.
FIG. 11 is a transparent perspective view of one biasing means in keeping with to teachings of the present invention.
FIG. 12 is a partial transparent and perspective view of a connecting portion of a structural assembly and a base having a portion of the biasing means illustrated.

With reference again to FIG. 5 and now to FIGS. 10-12, biasing means 72 is operable with one side 34, 36 of the structural assembly 32 and a corresponding base 24, 28. For the embodiment herein described by way of example with reference to FIG. 5, biasing means is installed on both sides 34, 36 of the structural assembly 32.

While various structural elements will come to the mind of those skilled in the art, now having the benefit of the present invention, one embodiment of the biasing means comprises a cable 74 having a looped first end 76 attached to a post 78 within each base 24, 28, as illustrated with continued reference to FIGS. 10-12. A coil spring 80 has a first end 82 attached to the structural assembly 32. The spring 80 extends into a tubular portion 84 of a lower side 34, 36 of the structural assembly 32 and has its second end 86 further spaced from the base 24, 28. The second end 88 of the cable 74 is attached to the second end 86 of the spring 80. The combination of a length of the cable 74 and length or tension on the spring 80 provides a biasing force 90 of the structural assembly 32 toward the towing position 40. One embodiment comprises the spring 80 and cable 74 combination providing the biasing force 90 counteracting a gravitational force 92 on the structural assembly 32 during its rotation, thus allowing a user to easily rotate the structural assembly to and from the towing and stored positions.

As illustrated with reference again to FIGS. 10 and 11, the spring 80 is carried within a tube 94 and the cable 74 runs within a center of the coil spring 80. Use of the tube 94 reduces noise resulting from vibration of the spring 80 and also acts as a bushing within which the spring moves. Further, a cap 96 is attached to the cable second end 88, which cap is sufficiently dimensioned to engage the spring second end 86. The cable 74 engages a pulley 98 positioned proximate an extreme end of the sides 34, 36. Yet further, one embodiment includes the spring 80 having a conical shape, thus allowing for an increased travel distance within the confined space of the tubular portion 84. Such a combination allows for ease in installing the biasing means 72 and for a desirable efficiency during operation.

Figure 13:
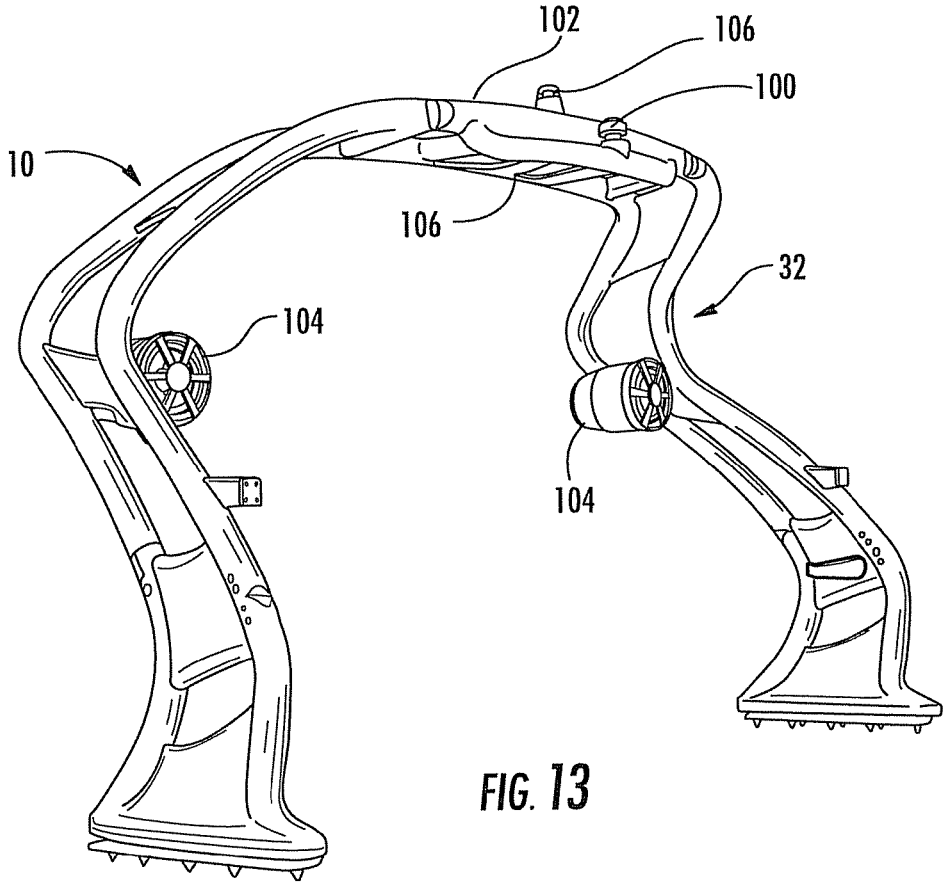
FIG. 13 is a rear perspective view of an embodiment including the towing apparatus carrying multiple stereo audio speakers.

For the embodiment herein described by way of example, and with reference again to FIGS. 4 and 5, and now to FIG. 13, a tow point 100 is attached to the structural assembly 32 proximate an uppermost location 102 distanced from the first and second bases 24, 28. With continued reference to FIG. 13, the structural assembly 32 may conveniently carry audio speakers 104 and lights 106 (overhead and running lights, by way of example). For the embodiment herein described, the audio speakers 104 are rotatably mounted to the structural assembly 32.

Figure 16A:
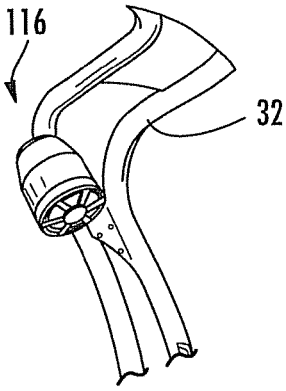
FIGS. 16A-16C are partial perspective views of one audio speaker of FIG. 13 illustrating a rotatable feature and the speaker set at multiple positions.
Figure 16B:
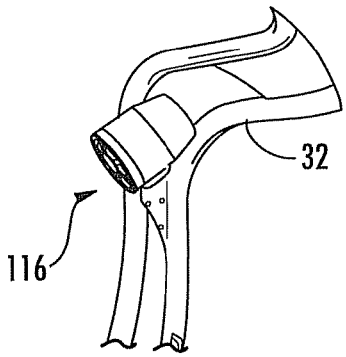
Figure 16C:
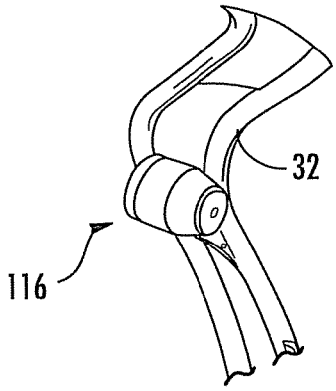
Figure 14:
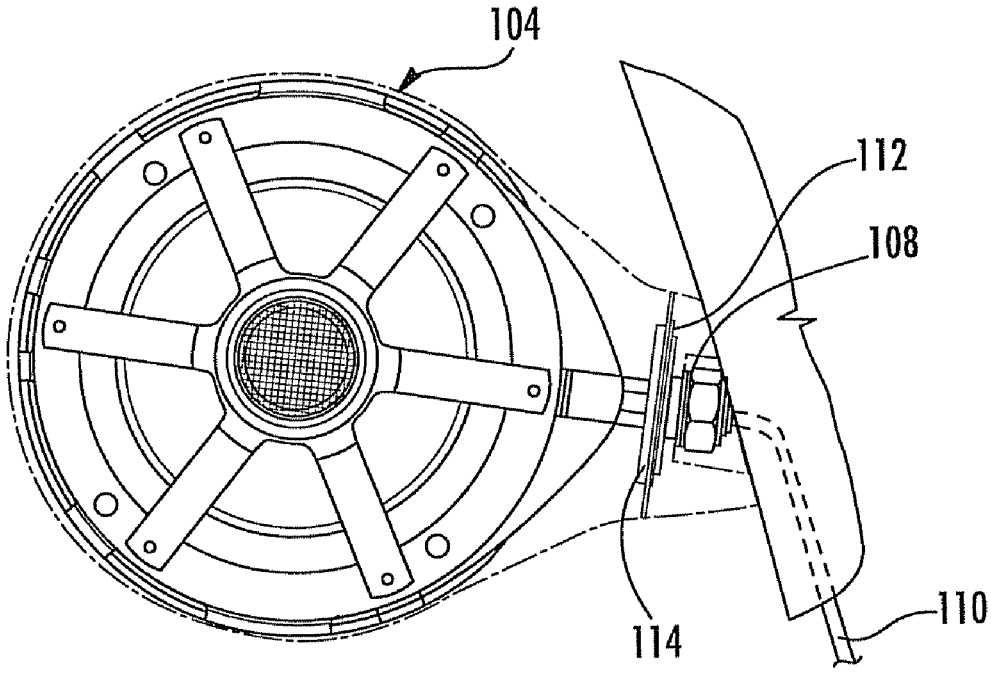
FIGS. 14 and 15 are partial transparent views of the audio speakers of FIG. 13 illustrating the speaker in forward and downward positions, respectively.
Figure 15:
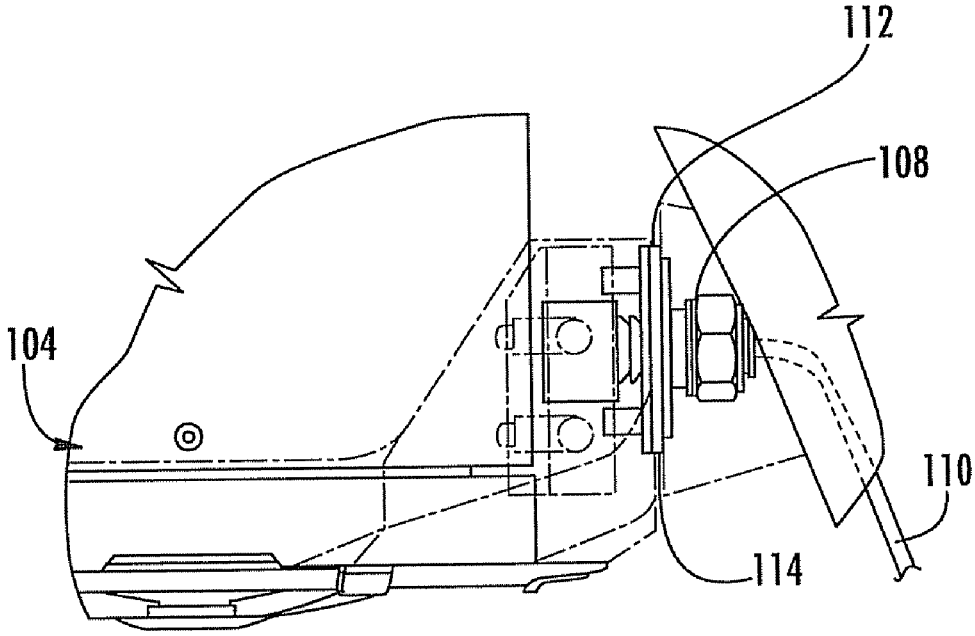

With continued reference to FIG. 13 and now to FIGS. 14 and 15, the audio speakers 104 are mounted to the structural assembly 32 using a bolt 108 having a hole therethrough for receiving an audio wire 110 therethrough. Ball plungers 112 are used with plates 114 to add friction against rotation of the audio speakers 104. The plates 114 include registration dimples for positioning the rotated speakers at preselected orientations, as illustrated by way of example with reference to FIGS. 16A-16C.

With reference again to FIGS. 1 and 2, for the embodiment herein described, the vessel 12 comprises a windshield 118 and the first and second bases 24, 28 are fixedly attached to the starboard and port gunwales 26, 30 such that the structural assembly 32 is carried aft of the windshield 118 when the apparatus 10 is in the stored position 42. As herein presented by way of example, the structural assembly 32 is rotated downward and forward within the vessel 12.

As herein presented by way of example, and with reference again to FIGS. 3-5, the structural assembly 32 is further described as including a first curved side 120 pivotally connected to the first base 24 and a second curved side 122 pivotally connected to the second base 28. The first and second curved sides 120, 122 may be joined at their upper portions 124, 126 or alternatively connected to a top section 128, as herein described. The top section 128 is dimensioned to accommodate a width dimension of the vessel 12 such that the bases and sides are appropriate for a preselected width of the vessel and the top section 128 need only be modified to permit the upper portions of the sides to be rigidly connected and secured to starboard and port sides of the vessel as desired.

Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of claims supported by this disclosure.

That which is claimed is:

1. An apparatus comprising:

a first base;

a second base in spaced relation to the first base;

a structural assembly extending between and pivotally connected to the first and second bases for movement between an open position and a closed position;

a locking assembly operable with the structural assembly and at least one of the first and second bases, the locking assembly comprising:

a pin carried by at least one of the structural assembly and the base;

a hook rotatably carried by at least one of the base and the structural assembly; and a cam pivotally connected to the hook for movement of the hook between a locked position and a released position, wherein in the locked position, the hook includes a hooking portion thereof secured to the pin for fixing the structural assembly to the base, thus preventing a rotation of the structural assembly with the base, and wherein in the released position, the hooking portion is spaced from the pin so as to permit rotation of the structural assembly about the base; and biasing means operable with the structural assembly and at least one of the first and second bases, the biasing means comprising:

cable means having one end attached to at least one of the structural assembly and the at least one of the first and second bases; and spring means having one end attached to at least one of the structural assembly and the base, wherein an opposing end of the cable means is attached to an opposing end of the spring means so as to rotatably bias the structural assembly toward the closed position.

2. The apparatus according to claim 1, wherein at least one of the first and second bases comprises a first cavity, wherein the hook and the cam are carried within the first cavity, the cam rotatably by a shaft, and wherein the pin is carried by the structural assembly.

3. The apparatus according to claim 2, further comprising a handle operable with the shaft for rotation thereof and manual movement of the hook.

4. The apparatus according to claim 1, wherein the structural assembly comprises a second cavity, wherein the spring means and a portion of the cable means is carried within the second cavity, wherein the one end of the cable means is attached to the base and the opposing end of the cable means is attached to the opposing end of the spring means within the second cavity, wherein the one end of the spring means is attached to the structural assembly and the opposing end of the spring means is moveable within the second cavity toward and away from the base during rotation of the structural assembly about the base.

5. The apparatus according to claim 4, wherein the spring means comprises a coil spring, and wherein the cable means comprises a cable extending within the coil spring.

6. The apparatus according to claim 5, further comprising a tube having the spring operable therein.

7. The apparatus according to claim 1, wherein at least one of the structural assembly and the first and second bases comprise a tubular structure.

8. The apparatus according to claim 1, further comprising a tow point attached to the structural assembly at an uppermost distanced location from the first and second bases.

9. The apparatus according to claim 1, further comprising at least one of an audio speaker and a light carried by the structural assembly.

10. An apparatus comprising:

a first base;

a second base in spaced relation to the first base;

a structural assembly extending between and pivotally connected to the first and second bases for movement between an open position and a closed position;

a locking assembly operable with the structural assembly and at least one of the first and second bases, the locking assembly comprising:

a pin carried by at least one of the structural assembly and the base;

a hook rotatably carried by at least one of the base and the structural assembly; and a cam pivotally connected to the hook for movement of the hook between a locked position and a released position, wherein in the locked position, the hook includes a hooking portion secured to the pin for fixing the structural assembly to the base, thus preventing a rotation of the structural assembly with the base, and wherein in the released position, the hooking portion is spaced from the pin so as to permit rotation of the structural assembly about the base, the hook rotatable with the cam from the released position to adjacent the pin by rotation of the shaft in one direction and the hooking portion slidable along the pin into the locking position by a continued rotation of the shaft in the one direction.

11. The apparatus according to claim 10, wherein at least one of the first and second bases comprises a first cavity, wherein the hook and the cam are carried within the first cavity, the cam rotatably by a shaft, and wherein the pin is carried by the structural assembly.

12. The apparatus according to claim 11, further comprising a handle operable with the shaft for rotation thereof and manual movement of the hook.

13. The apparatus according to claim 10, further comprising biasing means operable with the structural assembly and at least one of the first and second bases, the biasing means comprising:

cable means having one end attached to at least one of the structural assembly and the at least one of the first and second bases; and spring means having one end attached to at least one of the structural assembly and the base, wherein an opposing end of the cable means is attached to an opposing end of the spring means so as to rotatably bias the structural assembly toward the closed position.

14. The apparatus according to claim 13, wherein the structural assembly comprises a second cavity, wherein the spring means and a portion of the cable means is carried within the second cavity, wherein the one end of the cable means is attached to the base and the opposing end of the cable means is attached to the opposing end of the spring means within the second cavity, wherein the one end of the spring means is attached to the structural assembly and the opposing end of the spring means is moveable within the second cavity toward and away from the base during rotation of the structural assembly about the base.

15. A water sports vessel comprising:

starboard and port spaced apart gunwales;

an upwardly extending first base fixedly attached to the starboard gunwale;

an upwardly extending second base fixedly attached to the port gunwale;

an upwardly extending structural assembly extending between the first and second bases, the structural assembly having a lower first side pivotally connected to the first base and a lower second side pivotally connected to the second base for movement of the structural assembly between a towing position to a stored position;

at least one locking assembly operable with the structural assembly and at least one of the first and second bases, the locking assembly comprising:

a pin carried by at least one of the structural assembly and the base;

a hook rotatably carried by at least one of the base and the structural assembly; and a cam pivotally connected to the hook for movement of the hook between a locked position and a released position, wherein in the locked position, the hook includes a hooking portion thereof secured to the pin for fixing the structural assembly to the at least one of the first and second bases, thus preventing a rotation of the structural assembly with the at least one of the first and second bases, and wherein in the released position, the hooking portion is spaced from the pin so as to permit rotation of the structural assembly about the at least one of the first and second bases; and at least one biasing means operable with the structural assembly and at least one of the first and second bases, the biasing means comprising:

cable means having one end attached to at least one of the structural assembly and at least one of the first and second bases; and spring means having one end attached to at least one of the structural assembly and at least one of the first and second bases, wherein an opposing end of the cable is attached to an opposing end of the spring so as to rotatably bias the structural assembly toward the closed position, and wherein the spring means and cable means combination provide sufficient bias to counteract a gravitational force on the structural assembly during a rotation thereof.

16. The vessel according to claim 15, wherein the base comprises a first cavity, wherein the hook and the cam are carried within the first cavity, the cam rotatably by a shaft, and wherein the pin is carried by the structural assembly.

17. The vessel according to claim 15, further comprising a handle operable with the shaft for rotation thereof and manual movement of the hook.

18. The vessel according to claim 15, wherein the structural assembly comprises a second cavity, wherein the spring means and a portion of the cable means is carried within the second cavity, wherein the one end of the cable means is attached to the base and the opposing end of the cable means is attached to the opposing end of the spring means within the second cavity, wherein the one end of the spring means is attached to the structural assembly and the opposing end of the spring means is moveable within the second cavity toward and away from the base during rotation of the structural assembly about the base.

19. The vessel according to 18, wherein the spring means comprises a coil spring, and wherein the cable means comprises a cable extending within the coil spring.

20. The vessel according to claim 19, further comprising a tube having the spring operable therein.

21. The vessel according to claim 15, wherein the structural assembly and the first and second bases comprise a tubular structure.

22. The vessel according to claim 15, further comprising a tow point attached to the structural assembly at an uppermost distanced location from the first and second bases.

23. The vessel according to claim 15, further comprising at least one of an audio speaker and a light carried by the structural assembly.

24. The vessel according to claim 15, further comprising a windshield, wherein the first and second bases are fixedly attached to the starboard and port gunwales such that the structural assembly is carried aft of the windshield when in the stored position.

25. The vessel according to claim 24, wherein the structural assembly is rotated downward and forward within the vessel.

* * * * *